United States Patent [19]

Stetson et al.

[11] 4,232,076

[45] Nov. 4, 1980

[54] METHODS OF OBTAINING DEEP THROUGH PENETRATION OF COLORANTS INTO POLYVINYL CHLORIDE COMPOSITIONS, AND THE RESULTING PRODUCTS

[75] Inventors: John R. Stetson, Lebannon; Alan A. Graham, Mercerville, both of N.J.; Rudolf Frisch, Yardley, Pa.

[73] Assignee: Congoleum Corporation, Kearny, N.J.

[21] Appl. No.: 960,402

[22] Filed: Nov. 13, 1978

[51] Int. Cl.[2] ..... B32B 3/12; B32B 5/16

[52] U.S. Cl. ..... 428/158; 156/79; 427/270; 428/206; 428/207; 428/913; 428/914

[58] Field of Search ..... 428/206, 207, 158, 159, 428/913, 914; 8/2.5 A; 427/270; 156/79

[56] References Cited

U.S. PATENT DOCUMENTS

| | | | |
|---|---|---|---|
| 2,918,702 | 12/1959 | Wetterau | 156/78 |
| 3,276,904 | 10/1966 | Palmer | 427/270 |
| 3,293,094 | 12/1966 | Nairn et al. | 428/158 X |
| 3,293,108 | 12/1966 | Nairn et al. | 156/78 X |
| 3,502,495 | 3/1970 | Akamatsu et al. | 428/207 |
| 4,059,471 | 11/1977 | Haigh | 428/914 X |

*Primary Examiner*—Thomas J. Herbert, Jr.

[57] ABSTRACT

Methods of obtaining deep through penetration of colorants into firmed printable gelled plastisol or sintered dry-blend polyvinyl chloride compositions which comprise: applying a transfer paper or other substrate coated with a sublimable disperse dye to the surface of a firmed printable gelled plastisol or sintered dry-blend polyvinyl chloride composition, wherein the polyvinyl chloride resin is in particulate form having an average particle size of from about 0.5 micron to about 420 microns and contains specified percentages of plasticizer and stabilizer; applying heat thereto in the range of from about 300° F. to about 430° F. for a period of time of from about 6 seconds to about 20 seconds, whereby the sublimable disperse dye sublimes and, while in the sublimed vapor phase, penetrates deeply into the firmed printable gelled plastisol or sintered dry-blend polyvinyl chloride composition; removing the transfer paper or other substrate, leaving the disperse dye in the firmed printable gelled plastisol or sintered dry-blend polyvinyl chloride composition; applying a resinous polymer composition to the surface of the dyed firmed printable gelled plastisol or sintered dry-blend polyvinyl chloride composition as a wear layer; and applying heat to the dyed firmed printable gelled plastisol or sintered dry-blend polyvinyl chloride composition in the range of from about 310° F. to about 470° F. to fuse the polyvinyl chloride resin.

16 Claims, 6 Drawing Figures

METHODS OF OBTAINING DEEP THROUGH PENETRATION OF COLORANTS INTO POLYVINYL CHLORIDE COMPOSITIONS, AND THE RESULTING PRODUCTS

The present invention relates to methods of obtaining deep, through penetration of colorants into polyvinyl chloride resinous compositions in the manufacture of decorative sheet materials such as, for example, resilient floor coverings, and like products. The present invention also relates to the products resulting from or existing during such methods.

BACKGROUND OF THE INVENTION

Decorative sheet materials, and particularly resilient floor coverings, have been manufactured for many years and are customarily provided with surfaces having attractive patterns or designs printed thereon in various colors. However, after a period of time in use, these surface patterns or designs are worn away in places and the attractiveness of the variously colored surfaces is gradually diminished.

One method of avoiding, or at least postponing, the decreasing attractiveness of the variously colored patterns or designs, as they gradually wear in use, is to cover the surface of the decorative sheet material with a clear transparent coating or a wear layer which takes the brunt of the wear and is worn away gradually during the passage of time without affecting the attractiveness of the variously colored patterns or designs they protect. However, when the clear transparent coating or wear layer ultimately wears away, then the variously colored pattern or design begins to wear away and the attractiveness of the colored surface is diminished. Such methods are disclosed in many prior art patents, such as, for example, U.S. Pat. Nos. 3,293,094 and 3,293,108 to Nairn et al.

Another method of avoiding the decreasing attractiveness of the variously colored pattern or design is to have the various colorants penetrate deeply and completely through the decorative sheet material, so that, even as the surface of the decorative sheet material does wear away, the variously colored patterns or designs will not be visibly affected, insofar as an attractive appearance is concerned. Many methods have been devised in many efforts to achieve such desirable objects and purposes and are disclosed in many prior art patents, such as, for example, U.S. Pat. No. 3,276,904 to Palmer.

This is an excellent approach. However, such methods have not been completely successful or satisfactory and in many cases the various colors have migrated laterally or have bled and have run together. As a result, the variously colored patterns or designs have lost their sharpness of detail and have become undesirably blurred or indistinct.

A BRIEF SUMMARY OF THE INVENTION

It has been found that deep, through penetration of colorants may be obtained into polyvinyl chloride compositions such as firmed, printable gelled plastisol polyvinyl chloride compositions and sintered dry-blend polyvinyl chloride compositions which contain the polyvinyl chloride resin particulate form having an average particle size in the range of from about 0.5 micron to about 420 microns and from about 25 parts to about 150 parts of plasticizer per 100 parts of resin and from about 0.4 parts to about 10 parts of stabilizer per 100 parts of resin by applying to the surface of such polyvinyl chloride compositions a transfer paper or other release surface coated with the variously colored pattern or design formed with sublimable disperse dyes; applying heat thereto in the range of from about 300° F. to about 430° F. for a period of time of from about 6 seconds to about 20 seconds, whereby the sublimable disperse dyes which are in direct, intimate contact with the surface of the polyvinyl chloride composition sublime from their solid state into the vapor phase and, while in the sublimed vapor phase, penetrate deeply into and normally completely through the full thickness of the polyvinyl chloride composition. Subsequent removal of the transfer release paper or other release substrate reveals that the variously colored pattern or design is sharply detailed on the surface of the polyvinyl chloride composition, with no lateral migration or "bleeding" of the various colors, whereby distinctiveness of detail is not vague or blurred or fades during the active service life of the resilient floor covering. Further conventional or other processing may then be resorted to, such as, for example, the application of clear transparent coatings or wear layers; the application of heat to fuse, blow or foam the plastisol composition, if a blowing or foaming agent was included in the original formulation; or the application of heat and pressure to compress the polyvinyl chloride composition.

BRIEF DESCRIPTION OF THE DRAWINGS

In the following specification and accompanying self-explanatory drawings, there are described and illustrated preferred and typical embodiments of the present invention but is to be appreciated that the present invention is not to be construed as limited to such preferred and typical embodiments as are specifically disclosed and illustrated therein but to include other similar and equivalent embodiments, as are determined and defined by the scope of the appended claims. In such drawings, certain elements have been increased in size and shape, whereas other elements have been decreased in size and shape, simply and solely to illustrate more clearly some of the more important details of the invention.

Referring to the accompanying, self-explanatory drawings.

THE BEST MODE FOR CARRYING OUT THE INVENTION

The present invention will be further described with particular reference to firmed, printable gelled plastisol polyvinyl chloride compositions and to porous, sintered dry-blend polyvinyl chloride compositions as they are used and processed in the manufacture of resilient floor coverings. However, it is to be appreciated that the basic principles of the present invention are equally applicable to any and all polyvinyl chloride compositions which are used, per se, or in the manufacture of other articles, such as, for example, wall and ceiling coverings, desk, table and counter tops, etc., provided such other polyvinyl chloride compositions fall within the indicated parameters of particle size and plasticizer and stabilizer content in the polyvinyl chloride composition.

Figure 1:
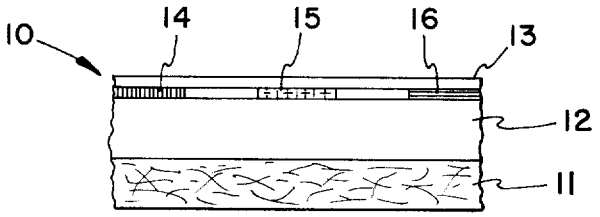
FIG. 1 is a fragmentary, diagrammatic, elevational, cross-sectional view of one embodiment of the invention, showing the transfer release paper coated with the sublimable disperse dyes applied to the gelled polyvinyl chloride plastisol composition, prior to the application of heat.

With particular reference to FIG. 1 of the drawings, there is shown therein a resinous polymer sheet material 10 comprising a base layer or sheet backing material 11 and a firmed, printable gelled polyvinyl chloride plastisol composition 12 to which has been applied in intimate contact a release transfer paper 13 which is coated on its underside with sublimable disperse dyes 14, 15, and 16 which are represented in the drawings for illustrative purposes only in red, yellow and blue colors, respectively.

THE BACKING MATERIAL

The backing material 11 which is used does not relate to the essence of the invention and, in fact, may be eliminated under certain circumstances and conditions. However, when a backing material 11 is used, it may comprise a felted or matted fibrous sheet of overlapping, intermingled fibers and/or filaments which are inorganic in nature, such as asbestos, glass, etc.; or organic in nature, such as natural fibers of cotton, jute, etc., or synthetic or man made, such as rayon, polyolefins, polyamides, acrylics, polyesters, etc.

The thickness of such a relatively flat sheet backing material 11 will depend to a large extent upon the particular product to be made and the particular subsequent use for which it is intended. Normally, such thicknesses are in the range of from about 10 mils to about 90 mils, but other thicknesses, especially those greater than 90 mils, may be used in special and particular circumstances. Other sheet materials such as non-woven, knitted, woven, or otherwise fabricated textile articles paper or paper products, or sheets or films of a plastic or resinous polmer composition are also of use as the backing material 11.

The backing material 11 is not an essential portion of the final product and, if desired or required, may be removed, or may not be used at all in the manufacturing process. In many cases, a strippable carrier, such as a steel or rubber endless belt, or release paper, or a felt, or other fabric having a release surface may be used as the backing material 11 and may be subsequently removed when its carrying purpose and function have been completed.

THE POLYVINYL CHLORIDE PLASTISOL COMPOSITION

The particular nature and the properties and characteristics of all the constituents of the polyvinyl chloride plastisol composition 12 do not relate to the essence of the invention, other than the fact that there is incorporated in such formulations the necessary proportions of the finely divided particulate polyvinyl chloride resin, a plasticizer or blend of plasticizer materials therefor, and a heat stabilizer. Other optional constituents of the polyvinyl chloride plastisol composition may include: a blowing or foaming agent, such as azodicarbonamide, if blowing or foaming is desired or required; UV and light stabilizers; coloring agents and pigments such as titanium dioxide; solvents and diluents such as methyl ethyl ketone, methyl isobutyl ketone, mineral spirits, etc.; fillers such as clay; accelerators, catalysts, etc.; foam control agents; viscosity control agents; antioxidants; germicides; fungicides; etc.

THE POLYVINYL CHLORIDE RESIN

As used herein, the polyvinyl chloride resin employed in the application of the principles of the present invention include the polyvinyl chloride homopolymer, itself, as well as copolymers of polyvinyl chloride with other copolymerizable monomers, yielding copolymers such as, for example, vinyl chloride-vinyl acetate copolymers such as "Vinyon"; vinyl chloride-vinylidene chloride copolymers such as "Saran; etc.

The polyvinyl chloride resin used in preparing the liquid or semi-liquid, pasty plastisols is a white powdery material and possesses a fine particulate size, primarily in the range of from about 0.5 micron to about 5 microns. Dispersion or emulsion grade resins (particle size average—0.5 micron to about 5 microns) are best suited for preparing such polyvinyl chloride plastisol compositions. Extender or blender suspension grade resins (particle size average—about 15 microns to about 60 microns) are also of use, although of a larger average particle size than dispersion or emulsion grade resins. Such blending and extender suspension grade resins, nevertheless, are also capable of use in the present invention, especially in the form of blends with the dispersion or emulsion grade resins. Such blends are capable of passing substantially completely through a No. 200 mesh screen (74 microns) with less than 1% retention on such a screen.

THE PLASTICIZERS

The specific plasticizer or blend of plasticizers which are used in the formulation of a particular foamable or non-foamable polyvinyl chloride plastisol composition does not relate to the essence of the present invention. It is sufficient merely that enough plasticizer be present to satisfactorily carry out its necessary plasticizing and solvating functions. Suitable plasticizers include: dibutyl sebacate, dibutyl sebacate, dioctyl sebacate, butyl benzyl sebacate, dibenzyl sebacate and other sebacic acid derivatives; dioctyl adipate, diisodecyl adipate, di(n-octyl-n-decyl) adipate, di(2-ethylhexyl) adipate, dodecyl adipate, and other adipic acid derivatives; dioctyl azelate, diisooctyl azelate, dihexyl azelate, di(2-ethylhexyl) azelate, and other azelaic acid derivatives; diisooctyl phthalate, di(2-ethylhexyl) phthalate, diisodecyl phthalate, ditridecyl phthalate, dibenzyl phthalate, dibutyl phthalate, butyl benzyl phthalate, dicapryl phthalate, dioctyl phthalate, dibutoxy phthalate. dibutoxy ethyl phthalate, alkyl benzyl phthalate, and other phthalic acid derivatives; tricresyl phosphate, cresyl diphenyl phosphate, triphenyl phosphate, and other phosphate esters; abietic acid derivatives; 2,2,4-trimethyl-1,3-pentanediol diisobutyrate; epoxydized tall oil ester; epoxydized soya oil; alkyl aryl hydrocarbons; dipropylene glycol dibenzoate; alkyd derivatives of rosin; chlorinated paraffins; high molecular weight hydrocarbon condensates; partially hydrogenated terphenyls; and many other primary and secondary plasticizers, or blends of the same.

Such plasticizers are present normally in the polyvinyl chloride plastisol composition in amounts ranging from about 20% by weight to about 60% by weight, based on the total weight of the polyvinyl chloride plastisol composition. Such values, of course, include both primary and secondary plasticizers. Preferably, however, within the more commercial aspects of the present invention, the plasticizer content in the polyvinyl chloride plastisol composition ranges from about 30% to about 50% by weight. Couching this in other terms, there is normally from about 25 parts to about 150 parts of plasticizer per 100 parts of polyvinyl chloride resin in the composition, and preferably from about 43 parts to about 100 parts of plasticizer per 100 parts of polyvinyl chloride resin in the composition.

THE STABILIZERS

The specific stabilizer or blend of stabilizers which are used in the formulation of a particular foamable or non-foamable polyvinyl chloride plastisol composition does not relate to the essence of the present invention. It is sufficient merely that enough stabilizer be present to reduce to a minimum or to substantially eliminate the undesirable effects and ravages of heat and light. Suitable stabilizers include: the sulfides and sulfites of various metals such as aluminum, silver, calcium, cadmium, magnesium, cerium, sodium, strontium, etc.; the phosphites of various metals such as zinc phosphite, dibasic lead phosphite, mixtures of such zinc and lead phosphites; metallic oxides such as zinc oxide; metallic octoates such as zinc octoate (18% zinc), lead octoate (24% lead), etc.

Such stabilizers are present normally in the polyvinyl chloride plastisol composition in amounts ranging from about 0.4 parts to about 10 parts of stabilizer per 100 parts of polyvinyl chloride resin in the composition and preferably from about 0.6 parts to about 6 parts of stabilizer per 100 parts of polyvinyl chloride resin in the composition.

THE FORMATION OF THE GELLED POLYVINYL CHLORIDE PLASTISOL

The polyvinyl chloride resin in very fine particulate size, the plasticizer, the stabilizer, and any other constituents which are to be included in the polyvinyl chloride plastisol composition 12 are then uniformly mixed and formulated together and are then applied to the backing material 11 in the form of a uniform, relatively thin, semi-fluid layer by means of a doctor blade, or by a roll coater, or is poured, cast, or otherwise applied and adhered to the backing material 11 by techniques well known in the art. The thickness of such an applied layer of plastisol coating, as applied and still wet or semi-fluid, is in the range of from about 5 mils to about 60 mils, or even more, if so desired or required.

The plastisol 12 is then heated under relatively gentle or moderate heat in an oven or other suitable heating means for a period of time of about 1 minute to about 4 minutes at an elevated temperature of from about 240° F. to about 470° F., but more normally commercially from about 290° F. to about 350° F., whereby the plastisol firms and gels to give it a good printable printing surface and to make it easier to be handled and processed in subsequent operations. It is to be observed that such heating is not to be that elevated or for a length of time as to cause blowing or foaming of the plastisol, if a blowor foaming agent had been included in the formulation. The temperature and the time relationships are mutually interdependent and the higher the oven temperature, the shorter is the required time of exposure to elevated heat, and vice versa. In any event it is believed that the temperature of the plastisol itself reaches a temperature of from about 240° F. to about 275° F. or perhaps up to 295° F. but such temperatures are not enough to fuse the polyvinyl chloride resin or to completely solvate the resin with plasticizer or to decompose or activate the blowing or foaming agent, if one is present.

THE HEAT TRANSFER RELEASE PAPER

The particular heat transfer release paper or other release substrate which is used in the application of the principles of the present invention does not relate to the essence of the invention and may be selected from a very wide variety of commercially available heat transfer release papers.

THE RAW PAPER

The particular raw heat transfer release paper 13 upon which the printing inks containing the sublistatic sublimable disperse dyes 14, 15, and 16 are to be applied does not relate to the essence of the invention and substantially any raw paper suitable as a base or substrate for printing inks containing sublimable disperse dyes can be employed. Such raw papers are available commercially in rolls having a base weight of from about 50 grams per square meter to about 70 grams per square meter, or they are also available commercially in sheets having various sizes and weights, such as, for example, 28×36 inches (500 sheets) having a basis weight of 30 pounds, 25×33 inches (500 sheets) having a base weight of 36 pounds, 25×33 inches (500 sheets) having a base weight of 40 pounds, 28×36 inches (500 sheets) having a base weight of 45 pounds, 25×38 inches (500 sheets) having a base weight of 50 pounds.

The surface to which the printing ink is to be applied should be smooth and slick (preferably publication advertising grade) and should either be machine glazed or machine finished. Clay coated papers yield very good results because the coating of clay forms a resistant barrier to the disperse dye as it sublimes and vaporizes, whereby less sublimed or vaporized dye escapes during the heat transfer process and less is held by the paper during such heat transfer. Smoothness and slickness are also desirable inasmuch as such surfaces provide for an easy removal of the raw paper after the heat transfer process is concluded.

The surface of the raw paper should also be suitable for or adaptable to the printing by the available machines and methods whether they be rotogravure, rotary screen, flexographic, lithographic, and so forth. The paper itself should not be porous but should be close enough in structure as to prevent any sublimed vapors or sublimate formed in the heat transfer process from escaping through the raw paper and going away from the material to be colored by the sublimable disperse dye. Such raw papers are commercially available from many paper manufacturers, such as those listed in the February, 1978 issue of The American Dyestuff Reporter, on pages 42–43. The commercial types of raw paper normally being used commercially are clay-coated, true blade and machine-glazed bleached kraft.

Other substrates including plastic sheets or films, closely woven or otherwise non-extendible or non-distensible fabrics, paper or paper products, and the like, are also of use within the broader aspects of the present invention as the carrier for carrying the sublimable disperse dyes.

THE SUBLIMABLE DISPERSE DYES

The particular sublimable disperse dye which is used in the formulation of the printing ink to be applied to the raw paper in the formation of the heat transfer paper does not relate to the essence of the present invention. The particular dye which is selected depends upon the particular pattern or design being used and the disperse dye may be chosen from a very wide variety of commercially available disperse dyes. Many of such sublimable disperse dyes suitable for heat transfer techniques are listed in "Dyes for Heat Transfer Printing" by Aihara et al., The American Dyestuff Reporter, February, 1975, pages 46–52. Additional dyes suitable for incorporation into printing inks for use in heat transfer printing are to be noted in The American Dyestuff Reporter, February, 1978, pages 44–49. The Color Index, published by the Society of Dyers and Colourists in England is also to be consulted.

The molecular weight of the sublimable disperse dyes suitable for application within the principles of the present invention conventionally fall within the relatively narrow range of from about 200 to about 400. Sublimable disperse dyes having molecular weight in the lower half of this range are preferred normally, inasmuch as they are low energy dyestuffs and tend to sublime more quickly and more readily at lower heat transfer temperatures.

Specific examples of sublimable disperse dyes which are found to be generally applicable within the principles of the heat transfer dyeing process include:

C. I. Disperse Yellow 1 C. I. 10345
C. I. Disperse Yellow 3 C. I. 11855
C. I. Disperse Red 4 C. I. 60755
C. I. Disperse Red 11 C. I. 62015
C. I. Disperse Red 13 C. I. 11115
C. I. Disperse Red 17 C. I. 11210
C. I. Disperse Orange 1 C. I. 11080
C. I. Disperse Violet 4 C. I. 61105

THE HEAT TRANSFER PRINTING INK

The particular heat transfer printing ink which is used in the application of the principles of the present invention does not relate to the essence of the invention and may be selected from a wide variety of commercially available transfer printing inks which can be purchased on the open market. A lengthy list of printing ink manufacturers and their many printing inks is to be found in the American Dyestuff Reporter, February, 1978, pages 49–51. Inasmuch as a very thin coating or film of the transfer printing ink is applied to the heat transfer paper or other substrate, the transfer printing inks must be relatively very concentrated in order to build up sufficient shade depth in the polyvinyl chloride composition. This is best done with solvent-, water-, or alcohol-water-based inks and dye crudes which contain no dispersing agents or other diluents. The crude dyes are milled in concentrated form with a resin binder and a solvent and then diluted, as desired or required. The following approximate formulations are typical:

1–5% by weight of the sublimable disperse dye
12–20% by weight of resin binder (ethyl cellulose, polyvinyl chloride, polyvinyl acetate, acrylics, etc.)
75–85% by weight of solvent (alcohols, esters, ketones, water)
0–10% by weight of a thermoplastic binder for tack
5% by weight of the sublimable disperse dye
95% by weight of the ink medium prepared from 200 ml. "Vinamul" 6000 (polymethyl methacrylate emulsion); 780 ml. methyl or ethyl alcohol; and 40 ml. ammonia (comm.)

THE HEAT TRANSFER DYEING PROCESS

Figure 2:
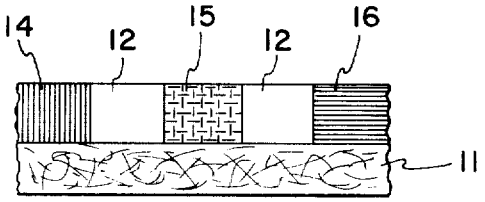
FIG. 2 is a fragmentary, diagrammatic, elevational, cross-sectional view of the embodiment of the invention illustrated in FIG. 1, after the application of heat and subsequent to the removal of the transfer release paper.

The heat transfer paper 13 with the sublimable disperse dyes 14, 15, and 16 of the printing ink composition facing downward is brought into direct, intimate pressure-bearing-contact with the surface of the gelled polyvinyl chloride composition 12, as is shown in FIG. 1 of the drawings. Intimate physical contact under pressure is maintained under heated roller-blanket or belt pressure or by heated platen pressure between the heat transfer paper 13 and the gelled polyvinyl chloride composition and such materials are raised to an elevated temperature of from about 300° F. to about 430° F. for a period of time of from about 6 seconds to about 20 seconds. As a result, the sublimable disperse dyes 14, 15, and 16 sublime directly from the solid state to the vapor phase, evanesce from the heat transfer paper 13, and penetrate deeply into the gelled polyvinyl chloride plastisol composition 12. At the conclusion of the heat transfer dyeing process and subsequent to the emergence of the gelled polyvinyl chloride plastisol composition from the heated roller-blanket or belt apparatus or from the heated platen, the heat transfer paper 13 may be stripped from the surface of the gelled polyvinyl chloride plastisol composition 12 and the resulting product is shown in FIG. 2.

It is to be observed in the Figures of the drawings that the sublimable disperse dyes 14, 15, and 16 evanesce directly from the heat transfer paper 13 into the gelled polyvinyl chloride plastisol composition 12 in straight lines and create clearly defined and sharply delineated outlines of the desired pattern or design. As will be disclosed hereinafter, such clearly defined and sharply delineated outlines of the desired colored pattern or design do not migrate laterally or "bleed" into adjacent colors or dyes to create a blurred or indistinct colored pattern or design over a two years test period. There is also no discoloration of the dyed areas into any undyed areas. Further details concerning the heat transfer dyeing process are to be found in U.S. Pat. No. 2,663,612 and in French Pat. No. 1,223,330.

It is, of course, to be appreciated that the desired colored or multicolored pattern or design of sublimable disperse dyes may be printed directly on the surface of the gelled polyvinyl chloride plastisol composition 12, without using a heat transfer paper 13, followed by the application of sufficient heat at elevated temperatures and pressures to sublime and vaporize the sublimable disperse dyes to cause them to penetrate into and through the gelled polyvinyl chloride plastisol composition. Application of a protective sheet or film of a relativly non-porous nature to the surface of the printed, gelled polyvinyl chloride plastisol composition prior to the sublimation heating operation is advisable to insure that the sublimed, vaporized dyes penetrate into the gelled polyvinyl chloride plastisol composition rather than escaping away therefrom in other directions. Such a protective sheet or film may be plastic sheets or films, relatively impervious fabrics and paper, rubber belts and the like.

Polyvinyl chloride homopolymer resin, as is generally common with polyvinyl chloride copolymer resins, such as vinyl acetate vinyl chloride copolymers and vinyl chloride-vinylidene chloride copolymers, for example, have relatively low softening and melting points and low fusing temperatures which are normally below or undesirably near the lowest temperature suitable for the application of the principles of the heat transfer process in general. As a result, efforts to apply such heat transfer process techniques to polyvinyl chloride homopolymers and copolymers in fiber, filament, fabric or other finished form or shape have hitherto been unsatisfactory and unsuccessful since the fibers, filaments, fabrics and other finished articles soften, melt or fuse undesirably before the elevated temperatures required for the heat transfer process are reached. Such softening, melting or fusing changes the properties and the characteristics, as well as the appearance of such fibers, filaments and fabrics undesirably.

In the present instance, however, the polyvinyl chloride resin is present in a different physical form, namely, a particulate form and the material being dyed is present in an unfinished form and shape. Additionally, it is to be noted that considerable concentrations of plasticizer and stabilizer are present. As a result, the elevated temperature of the heat transfer process which is exerted for only a relatively short period of time of seconds is barely sufficient to only partially soften, melt or fuse the particulate polyvinyl chloride resin and to only partially solvate the particulate polyvinyl chloride resin with plasticizer. Additionally, such effects are not objectionable under the existing circumstances and conditions, inasmuch as the material being dyed is not in a finished form or shape and it will be subsequently necessary to expose the polyvinyl chloride particulate resin to elevated temperatures for longer periods of time during the subsequent fusingm blowing or foaming operations, wherein complete fusion of the particulate polyvinyl chloride resin takes place, along with complete solvation of the polyvinyl chloride resin with the plasticizer, whereby maximum product strength is obtained. Thus, the use in this particular application presents an entirely different situation than that which exists with the application of the heat transfer process to fibers, filaments, fabrics, and other products having a finished or final form or shape.

THE EMBODIMENT OF FIGS. 3 AND 4

Figure 3:
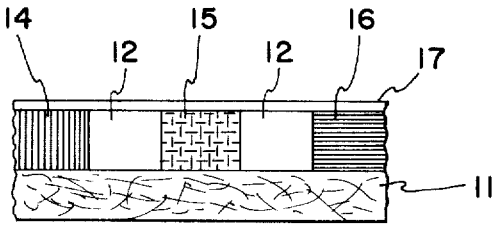
FIG. 3 is a fragmentary, diagrammatic, elevational, cross-sectional view of another embodiment of the invention wherein a wear layer is applied over the embodiment of the invention illustrated in FIG. 1, subsequent to the removal of the transfer release paper and prior to a second application of heat.

After the heat transfer paper 13 is removed from the surface of the polyvinyl chloride composition 12, as shown in FIG. 2, a second polyvinyl chloride plastisol composition, or other resinous polymer composition, in the form of a wear layer 17, having the same or a different formulation than the polyvinyl chloride composition 12, may be applied to the top surface of the polyvinyl chloride composition 12, as shown in FIG. 3, and may then be exposed to the same elevated temperature, time and other conditions as was previously described for the heat transfer process. The sublimable disperse dyes 14, 15, and 16 surprisingly again sublime and evanesce from the polyvinyl chloride composition 12 and penetrate into the wear layer 17, thus carrying the colored pattern or design completely to the top surface of the resinous polymer sheet material 10. The clearly defined and sharply delineated outlines of the desired colored pattern or design are thus notable in the wear layer 17. No blurring or bleeding or lateral migration of the disperse dyes 14, 15, and 16 are to be observed over a two year test period.

The thickness of the applied wear layer 17 is normally in the range of from about 2 mils to about 25 mils or even more, if an outstanding wear-resistant product is desired or required.

Figure 4:
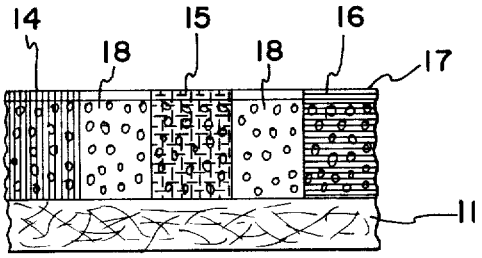
FIG. 4 is a fragmentary, diagrammatic, elevational, cross-sectional view of the embodiment of FIG. 3 but subsequent to the second application of heat, showing the expansion of the polyvinyl chloride resinous plastisol layer, due to the blowing or foaming effects of a blowing or foaming agent.

FIG. 4 also illustrates the effect of including a blowing or foaming agent in the polyvinyl chloride plastisol composition 12 whereby blowing and foaming of the polyvinyl chloride plastisol is realized. Such blowing and foaming may be accomplished at the same time that the wear layer 17 is dyed, as described previously, by employing the necessary elevated temperatures at that time to achieve both results of dyeing and blowing or foaming. Or, the blowing and foaming operation may be carried as a separate or subsequent operation. The temperature and time factors are determinative as to whether the two functions are carried out jointly or separately.

THE EMBODIMENT OF FIG. 5

Figure 5:
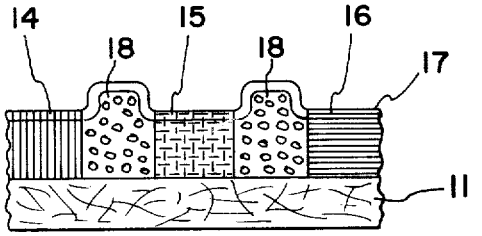
FIG. 5 is a fragmentary, diagrammatic, elevational, cross-sectional view of another embodiment of the invention, somewhat similar to the embodiment of FIG. 4 but wherein a blowing or foaming agent is included in the polyvinyl chloride resinous plastisol layer, as in FIG. 4, and wherein a blowing or foaming inhibitor is included in the sublimable disperse dye of the printing composition.

Thus far, no specific differential blowing or foaming or embossing of the resinous polymeric products of the heat transfer dyeing process have been described in detail, whereby raised and depressed areas may be obtained. FIG. 5 illustrates the effect of the differential blowing or foaming or embossing of a resinous product such as previously described with reference to FIGS. 3 and 4. In FIG. 5, a blowing or foaming agent is included substantially uniformly in the polyvinyl chloride plastisol composition 12 but no blowing or foaming agent is included in the wear layer 17. Such an arrangement is standard and is conventional and is the arrangement of FIGS. 3 and 4. In the embodiment of FIG. 5, however, a blowing or foaming inhibitor is included in the printing ink composition containing the sublimable disperse dyes 14, 15, and 16. This particular type of blowing or foaming inhibitor serves to prevent or to minimize the expansion of the areas in which they are contained. This is also well known in the chemical embossing art presently. Those portions of the polyvinyl chloride plastisol composition 12 which lie in the areas containing the sublimable disperse dyes and the inhibitor are relatively unchanged in thickness and have not expanded or become distended to any substantial degree as the result of the blowing and foaming operation. However, those portions of the polyvinyl chloride plastisol composition 12 which do not lie in the areas containing any sublimable dyes or inhibitors are considerably changed in thickness and have expanded and have become distended to a substantial degree to form lands or elevated areas 18 which contrast very sharply with the intervening valleys or depressed areas, as shown.

Although, in FIG. 5, the embossing effect of the inhibitor is illustrated as creating lower or depressed areas, it is to be appreciated that the opposite embossing effect may be realized wherein the particular inhibitor creates raised effects on the surface of the polyvinyl chloride composition. The inhibitor may thus generally be used to alter the decomposition or activation temperature of the blowing or foaming agent so as to yield such depressed or raised effects selectively, as desired or required. Further specific details of such blowing and foaming techniques are to be found in the U.S. Pat. Nos. 3,293,094 and 3,293,108 to Nairn et al.

Also, in FIG. 5, the blowing or foaming inhibitor has been shown as included in those portions of the pattern or design containing the sublimable disperse dyes, whereby the effect of such dyestuffs is observed in the mortar or relatively lower portions. The blowing or foaming inhibitor need not be included in all of the portions containing the sublimable disperse dyes but may be contained in only selected portions thereof. And the opposite or reverse effect could be created by placing the blowing or foaming inhibitor in those portions which do not contain any sublimable disperse dyes, whereby the effect of the dyestuffs is observed in the land or relatively higher portions.

It should be sufficient to state that the fusing, solvating, blowing and foaming procedures take place in an oven temperature of from about 300° F. to about 470° F., depending upon the particular polyvinyl chloride composition being used. The foamable resinous polymer composition is thus heated in an elevated temperature sufficient to fuse the resin by completely solvating the resin with plasticizer and to decompose or activate the blowing or foaming agent. The temperature of the entire mass of resinous polymer composition upon the backing material 11 must reach the fusion temperature of the resin in order to obtain a product of maximum strength. Such fusion is usually obtained at a materials temperature of from about 300° F. to about 375° F., after which blowing or foaming occurs.

THE EMBODIMENT OF FIG. 6

It is not necessary that the firmed, printable polyvinyl chloride composition be a gelled polyvinyl chloride plastisol composition. The principles of the present invention are equally applicable to firmed, printable, sintered dry-blend polyvinyl chloride compositions, such as is illustrated in FIG. 6.

The manufacture of such a firmed, printable, sintered dry-blend polyvinyl chloride composition is described in great detail in U.S. Pat. No. 3,359,352 and is well illustrated in the Figures of such patent and especially FIG. 1 thereof. Very briefly, the manufacturing procedure comprises mixing polyvinyl chloride resin in particulate or granular form with sufficient concentrations of plasticizer, stabilizers, pigments, fillers, and other adjuvants, and depositing the substantially uniform mixture on a suitable sheet backing or carrying material, followed by a heat sintering process in an oven or other heating device at an elevated temperature, whereby the individual particles of polyvinyl chloride resin soften and fuse together to form a porous, coherent dry-blend mass.

Figure 6:
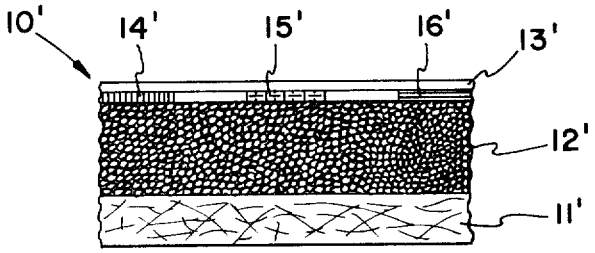
FIG. 6 is a fragmentary, diagrammatic, elevational, cross-sectional view of another embodiment of the invention wherein a porous, sintered dry-blend of particulate polyvinyl chloride resin is used as the substrate to be dyes by the sublimable disperse dyes.

FIG. 6 of the drawings represents the porous, sintered dry-blend mass after sintering and after a transfer release paper coated with a suitable sublimable disperse dye has been applied to its sintered surface. This, of course, is prior to the actual heat transfer dyeing process and even more prior to any subsequent heated blowing, foaming or curing operations.

In FIG. 6, there is illustrated a resinous polymer sheet material 10' comprising a relatively flat, sheet-like base layer or backing material 11' upon which has been applied and adhered a layer 12' of a substantially uniform mixture of a porous, particulate polyvinyl chloride resin, a suitable plasticizer or blend of plasticizers, a heat and light stabilizers or blend of such stabilizers, and other desired or required additives.

The particulate polyvinyl chloride resin used in the preparation of the dry-blend composition has an average particle size normally larger than the average particle size of the previously described dispersion, emulsion, suspension, extender, and blending grade resins used in the preparation of the polyvinyl chloride plastisol compositions and may have an average particle size up to about 420 microns, with substantially 100% of the resin particles passing through a No. 40 mesh U.S. Standard Sieve. Preferably, the particulate polyvinyl chloride resin is in the range of from about 74 microns to about 350 microns, with an average particle size up to about 250 microns.

Such polyvinyl chloride resin particles readily absorb the plasticizer with which they are uniformly mixed and the dry blend of materials is originally free-flowing and is dry to the hand, even though the blend of resin and plasticizer is formed within the limits of from about 25 parts by weight to about 150 parts by weight of plasticizer per 100 parts by weight of the polyvinyl chloride resin, with from about 43 parts to about 100 parts by weight per 100 parts of resin being preferred. The heat stabilizer content is also again in the range of from about 0.4 parts by weight to about 10 parts by weight per 100 parts by weight of the polyvinyl chloride resin, with from about 0.8 parts to about 6 parts by weight per 100 parts of resin being preferred.

Sintering and adhering together of the polyvinyl chloride resin particles takes place at an elevated temperature of from about 250° F. to about 400° F. and preferably from about 300° F. to about 375° F. After sintering, a transfer release paper or other release substrate 13' coated with suitable sublimable disperse dyes 14',15', and 16' are applied to the surface of the firmed, printable, sintered, porous dry-blend and such intermediate product is ready for the subsequent heat transfer dyeing process and other processing procedures.

After the heat transfer dyeing process which is substantially identical to the previously described heat transfer dyeing process used with the polyvinyl chloride plastisol composition is completed, and after the heat transfer paper 13' is removed, other subsequent processing as described previously herein follows, including an additional compressing and consolidation step under applied pressures of from about 100 pounds per square inch gauge to about 1000 pounds per square inch gauge at elevated temperatures, the final product is generally as shown in FIG. 2. A resinous polymer composition wear layer, as previously described hereinbefore, may be applied to obtain products generally similar to that illustrated in FIG. 3. The use of blowing or foaming agents, as well as blowing and foaming inhibitors, etc., may be desirable to obtain embossed effects somewhat generally similar to those illustrated in FIGS. 4 and 5.

PREHEATING TECHNIQUES

In many cases, it is often desirable or even necessary to carry out preheating procedures at elevated temperatures whereby the subsequent heat transfer dyeing processes are expedited and are facilitated. For example, preheating of the gelled or dry-blend polyvinyl chloride composition to an elevated temperature prior to its intimate pressure contact with the sublimable disperse dyes on the heat transfer paper 13 will most likely make the gelled polyvinyl chloride plastisol composition 12, which is porous to begin with, even more porous whereby it is believed to be even more receptive to absorbing the sublimed and vaporized sublimable disperse dyes 14, 15, and 16. Such preheating should be into the range of from about 330° F. to about 410° F. for a period of time of from about 6 seconds to about 15 seconds, depending primarily upon the thickness of the gelled polyvinyl chloride plastisol composition. As a result of such prior heat pretreatment, it has been found that the subsequent heat transfer dyeing process may be carried out at lower temperatures and for shorter periods of time.

In the same way, it is often desirable or even necessary to preheat the sublimable disperse dyes 14, 15, and 16, short of their sublimation temperatures, prior to their physical contact with the surface of the gelled polyvinyl chloride plastisol composition 12, whereby such dyes are in a better and a more suitable physical condition for actual sublimation and closer to their sublimation temperatures. Care must be exercised, however, to make certain that such sublimation temperature is not prematurely reached too early or prior to the actual contact of the dyestuffs with the gelled plastisol 12, or else portions or all of the sublimable disperse dyes 14, 15, and 16 may be lost.

Naturally, if desired or required, both the gelled polyvinyl chloride plastisol composition 12, as well as the sublimable disperse dyes 14, 15, and 16 may be preheated prior to being brought into intimate pressure contact in the heat transfer dyeing process. Such preheating may take place for both of these materials in a single heated oven or other heated device, or in two separate heated ovens, if it is desired or required that such preheating procedures be carried out at different elevated temperatures.

The present invention will be further described with particular reference to the following specific examples, wherein there are disclosed typical and preferred embodiments of the present inventive concept. However, it must be stated that such specific examples are primarily only illustrative of the present inventive concept and are not to be construed as limitative of the broader aspects of the inventive concept, except as defined by the spirit and the scope of the appended claims.

The following specific examples of potentially foamable polyvinyl chloride plastisol formulations are given for purposes of illustration but not for limitation of the invention

EXAMPLE I

| | Parts by weight |
|---|---|
| Polyvinyl chloride, dispersion grade, sp. vis. 0.60 | 50 |
| Polyvinyl chloride, dispersion grade, sp. vis. 0.40 | 50 |
| Butyl benzyl phthalate primary plasticizer | 25 |
| Di-(2-ethylhexyl) phthalate plasticizer | 45 |
| Titanium dioxide pigment | 7 |
| Azodicarbonamide blowing and foaming agent | 3 |
| V. M. & P. naphtha (boiling range 190–275° F.) | 5 |
| Zinc oxide stabilizer | 2 |

EXAMPLE II

| | |
|---|---|
| Polyvinyl chloride, dispersion grade, sp. vis. 0.60 | 50 |
| Polyvinyl chloride, dispersion grade, sp. vis. 0.40 | 50 |
| Alkyl aryl modified phthalate ester plasticizer | 55 |
| Alkyl aryl hydrocarbon secondary plasticizer | 10 |
| Dibasic lead phosphite stabilizer | 1.5 |
| Titanium dioxide pigment | 5 |
| Azodicarbonamide blowing and foaming agent | 2.5 |

EXAMPLE III

| | |
|---|---|
| Polyvinyl chloride, dispersion grade, sp. vis. 0.60 | 35 |
| Polyvinyl chloride, dispersion grade, sp. vis. 0.40 | 35 |
| Polyvinyl chloride, suspension grade, sp. vis. 0.35 | 30 |
| Alkyl aryl modified phthalate ester plasticizer | 55 |
| Alkyl aryl hydrocarbon secondary plasticizer | 10 |
| Dibasic lead phosphite stabilizer | 1.0 |
| Titanium dioxide pigment | 5 |
| Azodicarbonamide blowing and foaming agent | 1.7 |

EXAMPLE IV

| | |
|---|---|
| Polyvinyl chloride, dispersion grade, sp. vis. 0.60 | 100 |
| Di(2-ethylhexyl) phthalate plasticizer | 60 |
| Alkyl aryl hydrocarbon secondary plasticizer | 5 |
| Dibasic lead phosphite stabilizer | 1 |
| Titanium dioxide pigment | 2 |
| Azodicarbonamide blowing and foaming agent | 3 |

EXAMPLE V

| | |
|---|---|
| Polyvinyl chloride, dispersion grade, sp. vis. 0.60, high molecular weight | 34 |
| Polyvinyl chloride, dispersion grade, medium mol. wt. | 34 |
| Polyvinyl chloride, blending resin, larger particle size | 32 |
| Polymeric plasticizer, dibasic acid glycol | 70 |
| Stabilizer | 1.3 |
| Pigment | 3 |
| N,N'-dimethyl-N,N'dinitroso terephthalamide blowing agent | 5 |

EXAMPLE VI

| | |
|---|---|
| Polyvinyl chloride, low molecular weight | 100 |
| Dioctyl phthalate primary plasticizer | 90 |
| Dibasic lead phosphite stabilizer | 2 |
| p,p'-oxybis(benzene sulfonyl hydrazide)blowing agent | 6 |

EXAMPLE VII

| | |
|---|---|
| Polyvinyl chloride, high molecular weight | 100 |
| Dioctyl phthalate primary plasticizer | 80 |
| Dibasic lead phosphite stabilizer | 2 |
| p,p'-oxybis(benzene sulfonyl semicarbazide) blowing agent | 5 |

EXAMPLE VIII

| | |
|---|---|
| Polyvinyl chloride, high molecular weight | 100 |
| Dioctyl phthalate primary plasticizer | 100 |
| Dibasic lead phosphite stabilizer | 5 |
| N,N'-dimethyl-N,N'-dinitroso terephthalamide | 10 |

-continued

| |
|---|
| blowing agent |

EXAMPLE IX

| | |
|---|---|
| Polyvinyl chloride, dispersion grade, sp. vis. 0.40 low molecular weight | 100 |
| Dioctyl phthalate primary plasticizer | 75 |
| Dibasic lead phosphite stabilizer | 2 |
| Diazoaminobenzene blowing agent | 5 |

EXAMPLE X

| | |
|---|---|
| Polyvinyl chloride, high molecular weight | 50 |
| Polyvinyl chloride, low molecular weight | 50 |
| Dioctyl phthalate primary plasticizer | 100 |
| Dibasic lead phosphite stabilizer | 2 |
| Aminoguanidine bicarbonate blowing agent | 5 |

EXAMPLE XI

| | |
|---|---|
| Polyvinyl chloride, dispersion grade, sp. vis. 0.60 | 50 |
| Polyvinyl chloride, dispersion grade, sp. vis. 0.40 | 50 |
| Butyl benzyl phthalate primary plasticizer | 52 |
| Alkyl aryl hydrocarbon secondary plasticizer | 18 |
| Azodicarbonamide blowing agent | 3 |
| Dibasic lead phosphite stabilizer | 2 |
| Titanium dioxide pigment | 5 |
| V. M. & P. naphtha (boiling range 190°-275° F.) | 5 |

EXAMPLE XII

| | Pounds Weight |
|---|---|
| Polyvinyl chloride, dispersion grade | 560 |
| Polyvinyl chloride, extender grade | 250 |
| Filler | 100 |
| Butyl benzyl phthalate primary plasticizer | 224 |
| Alkyl benzyl phthalate primary plasticizer | 136 |
| Secondary plasticizer | 108 |
| Blowing mix: 19.2% azodicarbonamide blowing agent<br>7.2% stabilizer/accelerator<br>44.8% titanium dioxide pigment<br>27.2% plasticizer<br>1.6% surfactant | 80 |

The following examples of substantially non-foamable polyvinyl chloride plastisol formulations are given for purposes of illustration but not of limitation

EXAMPLE XIII

| | Parts by Weight |
|---|---|
| Polyvinyl chloride, dispersion grade, sp. vis. 0.50 | 100 |
| Dioctyl phthalate primary plasticizer | 17 |
| Tricresyl phosphate plasticizer | 8.5 |
| Epoxydized soya oil plasticizer | 8.5 |
| Stabilizer | 2 |
| V. M. & P. naphtha (boiling range 190-275° F.) | 18 |
| Methyl ethyl ketone | 2 |

EXAMPLE XIV

| | |
|---|---|
| Polyvinyl chloride, dispersion grade, sp. vis. 0.50 | 100 |
| Alkyl aryl modified phthalate ester plasticizer | 38 |
| Epoxydized tall oil ester secondary plasticizer | 5 |
| 2,2,4-trimethyl-1,3-pentanediol diisobutyrate | 7 |
| Stabilizer | 3 |
| Viscosity depressant | 1.2 |
| V. M. & P. naphtha (boiling range 190-275° F.) | 15 |

EXAMPLE XV

| | |
|---|---|
| Polyvinyl chloride, dispersion grade, sp. vis. 0.50 | 95 |
| Polyvinyl chloride, suspension grade, sp. vis. 0.35 | 5 |
| Alkyl aryl modified phthalate ester plasticizer | 38 |
| Epoxidized tall oil ester secondary plasticizer | 5 |
| 2,2,4-trimethyl-1,3-pentanediol diisobutyrate plasticizer | 7 |
| Stabilizer | 3 |
| Viscosity depressant | 0.3 |
| V. M. & P. naphtha (boiling range 190-275° F.) | 2 |

EXAMPLE XVI

| | |
|---|---|
| Polyvinyl chloride, dispersion grade, sp. vis 0.50 | 50 |
| Polyvinyl chloride, dispersion grade, sp. vis. 0.40 | 50 |
| Alkyl aryl modified phthalate ester plasticizer | 45 |
| Alkyl aryl hydrocarbon secondary plasticizer | 5 |
| Stabilizer | 3 |
| Viscosity depressant | 1 |
| Titanium dioxide pigment | 5 |
| V. M. & P. naphtha (boiling range 190°-275° F.) | 2 |

EXAMPLE XVII

| | Pounds Weight |
|---|---|
| Polyvinyl chloride, dispersion grade | 410 |
| Polyvinyl chloride, extender grade | 500 |
| Dodecyl benzene plasticizer | 50.4 |
| Benzyl phthalate plasticizer | 178.6 |
| Dioctyl phthalate primary plasticizer | 55 |
| 2,2,4-trimethyl-1,3-pentanediol diisobutyrate plasticizer | 80 |
| Epoxidized tall oil ester secondary plasticizer | 45 |
| Ba-Zn phosphite stabilizer | 27 |
| Viscosity depressant | 4 |
| V absorber | 3 |
| Violet color mix | 2 |

EXAMPLE XVIII

A resinous polymer decorative sheet material, such as shown in FIG. 4 of the drawings is made as follows: The backing sheet material comprises a relatively flat, 0.040 inch thick fibrous sheet of felted, matted asbestos fibers with an acrylic smoothing or leveling coating thereon. This backing sheet material is coated substantially uniformly to a wet thickness depth of about 0.015 inch with a layer of potentially foamable polyvinyl chloride plastisol composition having the formulation of Example XII. Gelling and firming of the semi-fluid potentially foamable polyvinyl chloride plastisol composition takes place in a heated oven temperature at an elevated temperature of about 300° F. for a period of time of about 3 minutes. The surface of the gelled plastisol is firm and printable. Such elevated temperature is not sufficiently high as to decompose or activate the azodicarbonamide blowing and foaming agent.

A 35-pound bleached Kraft heat transfer dyeing paper "Flotasia" California Red Design 76078 (Flo-Tech Corporation, Two Lee Blvd. Frazer, Pa. 19355) having sublistatic sublimable disperse dyes (primarily of variously shaded hues of red and yellow colors) flotation printed thereon by techniques described in U.S. Pat. Nos. 3,679,784 and 3,678,891 is placed in intimate, pressure contact with the gelled and firmed printed potentially foamable polyvinyl chloride plastisol composition in the configuration illustrated in FIG. 1 of the drawings.

Heat at an elevated temperature of about 360° F. is supplied, using a steel over rubber roll planished with a steel top roll. Contact time between the heat transfer dyeing paper and the dyes thereon with the gelled polyvinyl chloride plastisol composition is about 10 seconds. Such conditions are sufficient to sublime the disperse dyes and to transfer them to the potentially foamable gelled polyvinyl chloride plastisol composition. The heat transfer dyeing paper is then removed, revealing a product with the various shades of red and yellow color extending deeply into the plastisol, such as shown in FIG. 2 of the drawings.

A clear substantially non-foamable polyvinyl chloride plastisol wear layer having the formulation of Example XVII is then cast on the heat-transfer-dyed potentially foamable polyvinyl chloride plastisol composition, as shown in FIG. 3 of the drawings, and the composite structure is heated in a fusion oven maintained at an elevated oven temperature of about 380° F. Exposure time in the heated oven atmosphere is about three minutes which is sufficient to fuse the polyvinyl chloride resin and to decompose or to activate the azodicarbonamide blowing agent, whereby the product shown in FIG. 4 of the drawings is obtained. The disperse dyes are clearly defined in the blown or foamed polyvinyl chloride layer and also in the top wear layer. The product is excellent and finds commercial acceptance as a resilient floor covering. A two year test of the product reveals that there is no blurring of the pattern or design and that there is no lateral migration or bleeding into adjacent dyed or undyed areas. The product shows good through penetration of the dyestuffs with very distinct straight line color separation with even very fine lines exhibiting very straight through penetration.

EXAMPLE XIX

The procedures described in Example XVIII are followed substantially as set forth therein with the exception that one of the sublimable disperse dyes is additionally provided with about 10% by weight of trimellitic anhydride blowing or foaming inhibitor. Differential blowing and foaming or chemical embossing is obtained subsequent to passage through the fusion and blowing or foaming oven. The final product is illustrated in FIG. 5 of the drawings. The overall visual and decorative effect of the heat transfer process and the chemical embossing process is excellent.

EXAMPLE XX

The procedures described in Example XVIII are followed substantially as set forth therein with the exception that the fibrous backing sheet material is given a thin release coating prior to the application of the potentially foamable polyvinyl chloride plastisol composition thereto. At the conclusion of the entire process, the fibrous backing sheet material is stripped away from the polyvinyl chloride composition. Such a product has increased flexibility and finds excellent service and use as a resilient floor covering in an environment different than that suitable for the product of Example XVIII.

EXAMPLE XXI

The procedures described in Example XVIII are followed substantially as set forth therein with the exception that a different heat transfer dyeing paper from a different source of supply is used. A first sample of the heat transfer dyeing paper is applied to the gelled polyvinyl chloride plastisol composition (which is not given any prior heat pretreatment) and the heat transfer dyeing process takes place at 410° F. for 12 seconds. The dye transfer results are considered "poor". This is repeated with a second sample of the same heat transfer dyeing paper with the heat transfer dyeing process taking place at 410° F. for 15 seconds. The dye transfer results are considered "fair". This is repeated with a third sample of the same heat transfer dyeing paper with the heat transfer dyeing process taking place at 410° F. for 20 seconds. Again, the dye transfer results are considered "fair".

A prior heat pretreatment program is then instituted. A fourth sample of the same heat transfer dyeing paper is used but the gelled polyvinyl chloride plastisol composition is first given a prior heat pretreatment at 380° for 12 seconds. The heat transfer dyeing process takes place at 380° F. for 12 seconds. The dye transfer results are considered "good". A fifth sample of the same heat transfer dyeing paper is used but the gelled polyvinyl chloride plastisol composition is first given a prior heat pretreatment at 400° F. for 10 seconds. The heat transfer dyeing process takes place at 400° F. for 10 seconds. The dye results are considered "excellent". A sixth sample of the same heat transfer dyeing paper is used but the gelled polyvinyl chloride plastisol composition is first given a prior heat pretreatment at 400° F. for 12 seconds. The heat transfer dyeing process takes place at 400° F. for 10 seconds. The dye transfer results are considered "excellent". These heat dyeing results are tabulated below as follows:

| Sample Number | Prior Heat Pretreatment | Heat Transfer Dyeing Process | Heat Transfer Dye Results |
|---|---|---|---|
| 1 | None | 410° F. 12 secs. | Poor |
| 2 | None | 410° F. 15 secs. | Fair |
| 3 | None | 410° F. 20 secs. | Fair |
| 4 | 380° F. 12 secs. | 380° F. 12 secs. | Good |
| 5 | 400° F. 10 secs. | Excellent | |
| 6 | 400° F. 12 secs. | 400° F. 10 secs. | Excellent |

The advantages and the benefits of the prior heat pretreatment given to the gelled polyvinyl chloride plastisol composition prior to the application of the heat transfer dyeing paper are notable in the above sample tests.

EXAMPLE XXII

The procedures set forth in Example XVIII are followed substantially as described therein with the exception that the gelled polyvinyl chloride plastisol composition of Example I is used as the potentially foamable polyvinyl chloride plastisol composition. The results of this Example are generally comparable to the results obtained in Example XVIII. The product is commercially acceptable as a resilient floor covering.

EXAMPLE XXIII

The procedures set forth in Example XVIII are followed substantially as described therein with the exception that the pattern or design is a simple block geometric pattern or design using the following sublimable heat transfer nitro disperse dye:

C. I. Disperse Yellow 1 (C. I. 10345)

The results of this Example are generally comparable to the results obtained in Example XVIII except that, of course, the pattern or design and the colors are different.

EXAMPLE XXIV

The procedures set forth in Example XVIII are followed substantially as described therein with the exception that the pattern or design is a simple geometric circle pattern or design using the following sublimable heat transfer monoazo disperse dye:

C. I. Disperse Red 17 (C. I. 11210)

The results of this Example are generally comparable to the results obtained in Example XVIII except that, of course, the pattern or design and the colors are different.

EXAMPLE XXV

The procedures set forth in Example XVIII are followed substanially as described therein with the exception that the pattern or design is a simple block geometric pattern or design using the following sublimable heat transfer anthraquinone disperse dye:

C. I. Disperse Violet 4 (C. I. 61105)

The results of this Example are generally comparable to the results obtained in Example XVIII except that, of course, the pattern or design and the colors are different.

It is to be observed that in all the preceding Examples which relate to the use of gelled polyvinyl chloride plastisol compositions, all dispersion and emulsion grade polyvinyl chloride resins used have a particle size in the range of from about 0.5 micron to about 5 microns, and that all suspension extender and blending polyvinyl chloride resins used have a particle size in the range of from about 15 microns to about 60 microns. All blends are capable of passing substantially completely through a No. 200 mesh screen (74 microns—U.S. Standard Sieve Series) with less than 1% by weight reyention on the screen.

EXAMPLE XXVI

A cellulosic fiber felt sheet having a thickness of about 0.043 inch is used as the relatively flat sheet backing material. A polyvinyl chloride dry-blend composition is prepared as follows: All polyvinyl chloride resin particulate materials are initially screened (100%) through a No. 40 mesh screen (420 microns). Mixing of the following constituents of the dry-blend formulation takes place at about 200° F. substantially as described in U.S. Pat. No. 3,359,352.

| | Parts by weight |
|---|---|
| Polyvinyl chloride homopolymer, sp. vis. 0.28 | 100 |
| Dioctyl phthalate primary plasticizer | 30 |
| Stabilizer | 3 |

The mixed particulate materials are then distributed on the cellulosic fiber felt sheet to form a substantially uniform layer of about 0.08 inch in thickness. This layer is heated for about three minutes in an oven maintained at an elevated temperature of about 350° F. During this heating, the particulate materials reach a temperature of about 330° F. and are sintered into a substantially uniform, homogeneous, porous, firm and adherent printable mass. This mass is cooled to room temperature, and is heat transfer dyed as follows: A 35 pound bleached Kraft heat transfer dyeing paper "Flotasia" California Red Design 76078 (Flo-Tech Corporation, Two Lee Blvd., Frazer, Pa. 19355) having sublimable sublistatic type printing inks thereon primarily of various shades of red and yellow disperse dyes printed thereon is placed in intimate, pressurized porous, printable dry-blend layer containing polyvinyl chloride resin, plasticizer and stabilizer, substantially as shown in FIG. 6 of the drawings.

Heat at an elevated temperature of about 360° F. is supplied with pressure bringing the entire surface of the sublimable disperse dyes into close intimate contact with the entire surface of the dry-blend mass with no gaps or spaces therebetween for a period of time of about 10 seconds. This is sufficient to sublime the disperse dyes coated on the heat transfer dyeing paper and to transfer the pattern or design to the surface of the dry-blend mass.

The printed, sintered dry-blend mass is then forwarded to a press which carries out a compression or consolidation step at an applied pressure of about 500 pounds per square inch guage, and at an elevated temperature of about 350° F. for a period of time of about 2 minutes.

The heat transfer dyeing paper is stripped away and it is noted that the printed pattern or design extends very deeply through the compressed or consolidated dry-blend mass. The general appearance is very similar to that illustrated in FIG. 2 of the drawings.

EXAMPLE XXVII

The procedures described in Example XXVI are followed substanially as set forth therein with the exception that a different formulation is used to prepare the sintered, porous dry-blend mass as follows:

| | Parts by Weight |
|---|---|
| Air Products 2861 polyvinyl chloride 5% copolymer 100% through No. 40 mesh screen (420 microns) and considerable amounts through No. 80 mesh screen (177 microns) | 100 |
| Dioctyl phthalate primary plasticizer | 35 |
| Stabilizer | 2 |

EXAMPLE XXVIII

The procedures described in Example XXVI are followed substantially as set forth therein with the exception that the polyvinyl chloride resin has a particle size in the range of from about 75 microns to about 380 microns.

The results of this Example are generally comparable to the results obtained in Example XXVI.

Although several specific examples of the inventive concept have been described in particularity, the same should not be construed as limiting the invention to the specific materials and procedures mentioned therein but to include various other materials and procedures, as well as equivalent features, as set forth in the claims appended hereto. It is to be understood that any suitable changes, modifications, and variations may be made without departing from the scope and the spirit of the broader aspects of the present invention.

What is claimed is:

1. A method of obtaining deep through penetration into firmed printable gelled plastisol or sintered dry-blend polyvinyl chloride compositions which comprises: applying a transfer paper or other release surface coated with a low energy, sublimable disperse dye having a molecular weight of from about 200 to about 400 to the surface of a firmed, printable gelled plastisol or sintered dry-blend polyvinyl chloride composition prepared from polyvinyl chloride resin in finely divided particulate form having a particle size of from about 0.5 micron to about 420 microns, from about 25 parts to about 150 parts of plasticizer per one hundred parts of polyvinyl chloride resin, and from about 0.4 parts to about 10 parts of a heat stabilizer per one hundred parts of polyvinyl chloride resin, said low energy, sublimable disperse dye being in direct, intimate contact with said polyvinyl chloride composition; applying heat to said polyvinyl chloride composition and said low energy sublimable disperse dye having a molecular weight of from about 200 to about 400 in the range of from about 300° F. to about 470° for a period of time of from about 6 seconds to about 20 seconds, whereby said low energy, sublimable disperse dye sublimes and, while in the vapor phase, penetrates into said firmed printable gelled plastisol or sintered dry-blend polyvinyl chloride composition and said polyvinyl chloride resin is substantially completely fused by being substantially completely solvated with said plasticizer; and removing said transfer paper or other release surface after said low energy, sublimable disperse dye has penetrated into said firmed, printable gelled plastisol or sintered dry-blend polyvinyl chloride composition and said polyvinyl chloride resin has been fused.

2. A method as defined in claim 1, wherein the particle size of said polyvinyl chloride resin is in the range of from about 0.5 micron to about 60 microns.

3. A method as defined in claim 1, wherein the particle size of said polyvinyl chloride resin is in the range of from about 0.5 micron to about 5 microns.

4. A method as defined in claim 1, wherein said polyvinyl chloride resin is a copolymeric polyvinyl chloride resin.

5. A method as defined in claim 1, wherein said polyvinyl chloride composition contains a blowing or foaming agent.

6. A method as defined in claim 1, wherein said polyvinyl chloride composition contains a blowing or foaming agent and at least one of said sublimable disperse dye contains a blowing or foaming inhibitor.

7. A method as defined in claim 1, wherein said firmed, printable gelled plastisol or sintered dry-blend polyvinyl chloride composition is preheated to a temperature of from about 330° F. to about 410° F. for a period of time of from about 6 seconds to about 15 seconds, prior to the application of said sublimable disperse dye thereto.

8. A method as defined in claim 1, wherein said sublimable disperse dye is carried on a release transfer substrate which is removed after said sublimable disperse dye has penetrated into said firmed, printable gelled plastisol or sintered dry-blend polyvinyl chloride composition.

9. A method as defined in claim 8, wherein a resinous polymer wear layer composition is applied over said polyvinyl chloride composition, after said release transfer substrate is removed.

10. A resinous polymer sheet material comprising: a layer of a fused polyvinyl chloride resin composition prepared from a finely divided particulate polyvinyl chloride resin having an average particle size in the range of from about 0.5 micron to about 420 microns, from about 25 parts by weight to about 150 parts by weight of a plasticizer per 100 parts by weight of said polyvinyl chloride resin, and from about 0.4 parts by weight to about 10 parts by weight of a heat stabilizer per 100 parts by weight of said polyvinyl chloride resin, said polyvinyl chloride resin being substantially completely fused by being substantially completely solvated with said plasticizer; and a colored pattern or design of a low energy sublimable disperse dye having a molecular weight of from about 200 to about 400 printed on the surface of and extending deeply through said layer of polyvinyl chloride resin composition, said colored pattern or design of a low energy sublimable disperse dye having a molecular weight of from about 200 to about 400 being formed on the underside face of a heat transfer release substrate and directly and intimately contacting the surface of said layer of a polyvinyl chloride resin composition.

11. A resinous polymer sheet material as defined in claim 10, wherein said particulate polyvinyl chloride resin has an average particle size in the range of from about 0.5 micron to about 60 microns.

12. A resinous polymer sheet material as defined in claim 10, wherein said particulate polyvinyl chloride resin has an average particle size in the range of from about 0.5 micron to about 5 microns.

13. A resinous polymer sheet material as defined in claim 10, wherein a resinous polymer wear layer composition is applied over said polyvinyl chloride composition, after said heat transfer release substrate is removed.

14. A resinous polymer sheet material as defined in claim 13, wherein said resinous polymer wear layer composition is a polyvinyl chloride resin composition.

15. A resinous polymer sheet material as defined in claim 10, wherein said layer of polyvinyl chloride resin composition contains a blowing or foaming agent.

16. A resinous polymer sheet material as defined in claim 15, wherein portions of said colored pattern or design contain an inhibitor for said blowing or foaming agent.

* * * * *